US008469556B2

(12) United States Patent
Gow

(10) Patent No.: US 8,469,556 B2
(45) Date of Patent: Jun. 25, 2013

(54) EXTENDING EMERGENCY LIGHT WITH A RECESSED, COVERED STORAGE CAVITY

(76) Inventor: Thomas W. Gow, Elkton, SD (US)

( * ) Notice: Subject to any disclaimer, the term of this patent is extended or adjusted under 35 U.S.C. 154(b) by 571 days.

(21) Appl. No.: 12/771,695

(22) Filed: Apr. 30, 2010

(65) Prior Publication Data

US 2010/0309014 A1 Dec. 9, 2010

Related U.S. Application Data

(60) Provisional application No. 61/174,222, filed on Apr. 30, 2009.

(51) Int. Cl.
*F21V 15/00* (2006.01)

(52) U.S. Cl.
USPC ..... 362/364; 362/20; 362/372; 362/439

(58) Field of Classification Search
USPC ..... 362/20, 364, 372, 439
See application file for complete search history.

(56) References Cited

U.S. PATENT DOCUMENTS 6,554,458 B1 * 4/2003 Benghozi ..... 362/365
2006/0133096 A1 * 6/2006 Corbett et al. ..... 362/372

* cited by examiner

*Primary Examiner* — Sean Gramling
(74) *Attorney, Agent, or Firm* — Nawrocki, Rooney & Sivertson, P.A.

(57) ABSTRACT

A safety unit for mounting in a wall defining a part of a building space has a tubular housing containing an emergency load such as a light sized to fit within the housing, said emergency load including a base and a light-emitting element. An actuator mechanism such as a motor carried on the housing provides force to the base responsive to electrical power to translate the base to deploy the emergency load within the building space. A preferred embodiment includes a cover and a cover-operating mechanism receiving force from the actuator to remove the cover as the load deploys.

7 Claims, 4 Drawing Sheets

EXTENDING EMERGENCY LIGHT WITH A RECESSED, COVERED STORAGE CAVITY

CROSS-REFERENCE TO RELATED APPLICATIONS

This is a regular application filed under 35 U.S.C. §111(a) claiming priority, under 35 U.S.C. §119(e)(1), of provisional application Ser. No. 61/174,222, previously filed Apr. 30, 2005 under 35 U.S.C. §111(b).

BACKGROUND

Building codes require that public spaces have electrically operated emergency lighting and signage (collectively "emergency loads" or "safety units" hereafter) in case of a power outage so that the occupants of the building can evacuate safely. Such emergency loads of course require an auxiliary power source that functions during a power outage.

Common building construction uses wallboard or other types of panels mounted on studs for the walls, or on joists for ceilings to define individual occupancy spaces (rooms, halls, etc.). The spaces between the studs or joists behind the panels are usually void or occupied by insulation. Particularly in commercial buildings and multiple dwellings, some ceilings use panels that fit into metal frames suspended from I-beams or poured concrete layers. For the sake of simplicity, all of these various types of room-defining panels having voids behind them will hereafter be referred to as "walls".

Many types of buildings have their emergency loads mounted in visible locations of halls, stairways, and other evacuation routes. These loads must be completely visible when deployed during power outages. But mounting these emergency loads so as to be visible when power is available may not be desirable for a couple of reasons. The emergency loads are often eyesores. And emergency loads mounted in visible locations are vulnerable to vandalism and to damage during cleaning, painting, etc.

These concerns have been known for a long time. Solutions have been difficult to devise.

BRIEF DESCRIPTION OF THE INVENTION

A safety unit for mounting in a wall defining a part of a building space, said safety unit activating responsive to electrical power. The safety unit comprises a tubular housing having first and second ends, with an axis extending along the length of the housing. The tubular housing is configured for mounting within a cavity of a wall with the second end of the housing substantially flush with an outer surface of the wall.

An emergency load such as a light source sized to fit within the housing includes a base and a light-emitting element. A guide within the housing mechanically interacts with the base, and extends generally along the housing's axis.

The guide's interaction with the base allows translation of the base generally along the housing from a standby position adjacent to the housing's first end to a deployed position adjacent to the housing's second end when the base receives force. The base supports the lighting element to place the lighting element within the housing when in the storage position and outside the housing when in the deployed position.

An actuator mechanism carried on the housing provides force to the base responsive to electrical power to shift the base between the standby and deployed positions for the emergence load.

One version of the safety unit includes a cover at the second end of the housing, mounted for rotation between first and second positions respectively closing and opening the second end of the housing. A linkage within the housing transmits force to the cover to rotate the cover between the first and second positions responsive to the force received from the linkage.

In a preferred version, the actuator mechanism comprises a motor mounted on the housing for rotating a shaft responsive to electrical power. The linkage comprises a jackscrew extending along the housing's axis receives torque from the motor and a threaded traveler carried by the jackscrew and attached to the base. The traveler shifts axially along the housing as the motor shaft rotates.

The linkage may further comprise a tab projecting from the base substantially transversely to the housing axis, said tab having a slot therein. An elongate strip having first and second ends mounted for rotation about its length within the housing extends along the housing's axis with the first ends of the housing and strip adjacent and the second ends of the housing and strip adjacent. The strip passes through the tab's slot with the cover attached to the second end of the strip The strip has a twist therein that is preferably adjacent to the strip's first end and between the base's tab and the strip's second end. As the twist passes through the tab's slot, the strip rotates, thereby swinging the cover from the second end of the housing.

The strip may include on its second end a cam and follower connected between the strip and the cover. As the strip rotates, the cam and follower axially shift the cover away from the housing's second end.

In another embodiment, a spring is connected between the housing and the base and urging the base toward the housing's first end. The actuator comprises a motor and a fan driven by the motor and within the housing, to force a stream of air within the housing and toward the base, of strength sufficient to overcome the spring force on the base and shift the base toward the deployed position.

DESCRIPTION OF THE PREFERRED EMBODIMENTS

Figure 1:
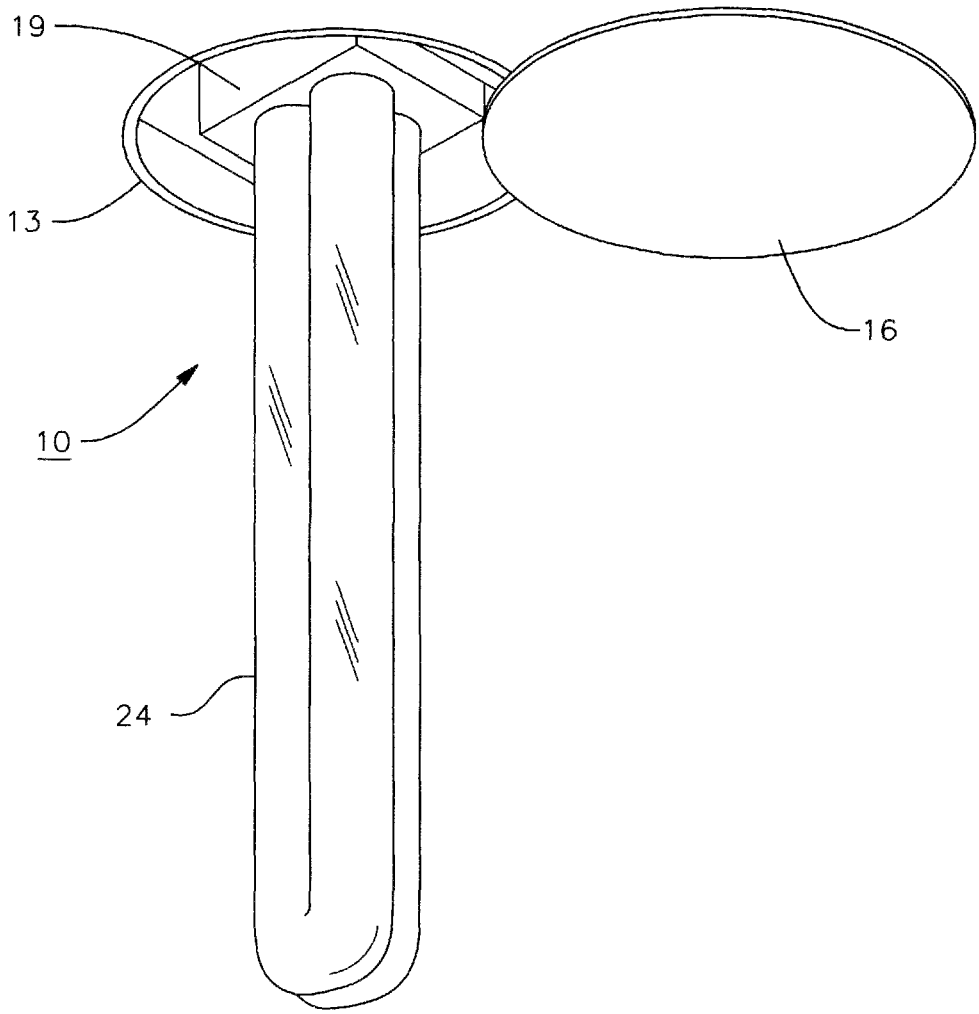
FIG. 1 is a perspective view of the deployed first version of the invention.
Figure 2:
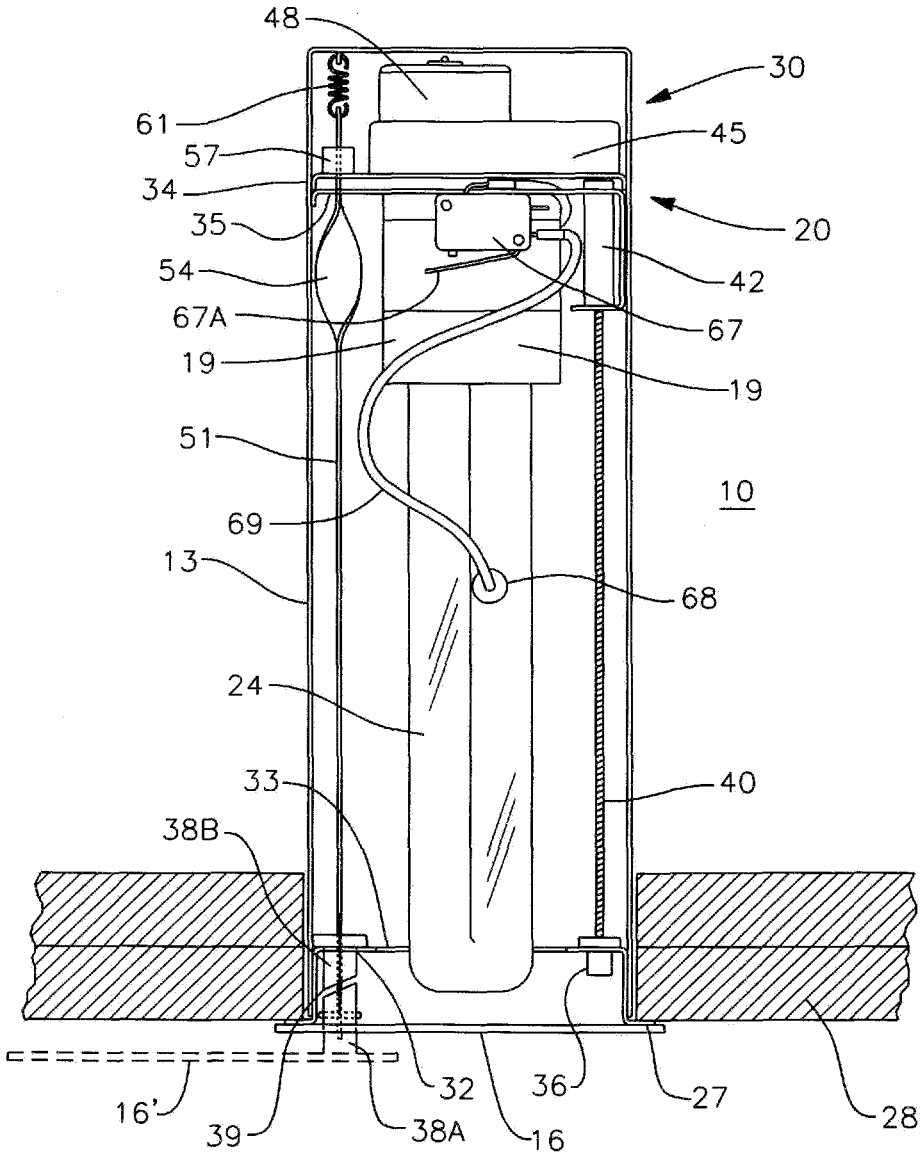
FIG. 2 is a side elevation section of the first version of the invention.

FIGS. 1 and 2 show a safety unit such as an emergency light fixture 10 suitable for fitting in the space behind or within a ceiling 28 such as a ceiling panel or a false ceiling. Fixture 10 may also fit in the space behind or within a wall. FIG. 1 shows as fixture 10, a deployed light source 24 such as a florescent tube. Other types of light sources such as LEDs are suitable as well.

An emergency power supply (not shown) provides actuating power for operating fixture 10 when power is lost to the building mains. FIGS. 1 and 2 show fixture 10 as comprising a tubular housing 13 having a longitudinal axis and containing the fixture 10 components. Fixture 10 is suitable to fit in an opening in wall 28 and project into the void behind wall 28. Light source 24, is sized to fit within housing 13.

In the deployed position shown in FIG. 1, light source 24 projects from the open end of housing 13. Light source 24 plugs into and is supported by a mounting socket 19 that moves between the top and bottom ends of housing 13 to reach standby and deployed positions respectively. FIG. 1 show socket 19 at the bottom end of housing 13 with light source 24 deployed. A cover 16 rotates to open housing 13, allowing socket 19 to shift to the deployed position.

Housing 13 has a flange 27 at the lower end that fits against the wall 28 surface to mount housing 13 in wall 28 with its bottom end in a near-flush position. An interior peripheral flange or ring 33 of housing 13 encircles the bottom end of the housing 13 interior.

FIG. 2 can be better understood with reference to FIGS. 3-6, which show perspective views of various components of fixture 10. FIG. 2 shows housing 13 enclosing a carrier assembly 20 mounted to slide or shift along a substantial portion of the axial length of housing 13. Assembly 20 supports and transports socket 19. A guide mechanism including a traveler element 42 and a jackscrew 40 transports and guides assembly 20 to shift axially between the standby position that FIG. 2 shows and the deployed or operating position of FIG. 1.

The carrier assembly 20 may have several different embodiments. Each of the possible embodiments have guide mechanism components along which carrier assembly 20 moves between the standby and deployed positions, and an actuator assembly at 30 for providing the force to shift carrier assembly 20 along the guide components.

In the embodiment of FIG. 2, a jackscrew 40 cooperates with a lid control shaft 51 to function as the both the guide mechanism and a part of the actuator assembly 30. The actuator assembly 30 includes a motor 48 and a gear train 45 that motor 48 drives. The output gear (not visible in FIG. 2) of gear train 45 supports an end of and drives jackscrew 40. A bearing 36 mounted on flange 33 supports the lower end of jackscrew 40 for rotation. The jackscrew output gear and the bearing 36 hold jackscrew 40 with little or no axial runout.

A jackscrew traveler element 42 connects to socket 19 and is in threaded engagement with jackscrew 40. The axial length of traveler element 42 is adequate to hold carrier assembly 20 and light source 24 in axial alignment with housing 13.

As actuator assembly 30 rotates jackscrew 40, traveler element 42 moves axially along jackscrew 40, shifting carrier assembly 20 between the standby and deployed positions. Motor 48 is reversible to allow carrier assembly 20 to shift between the standby and deployed positions.

Figure 5:
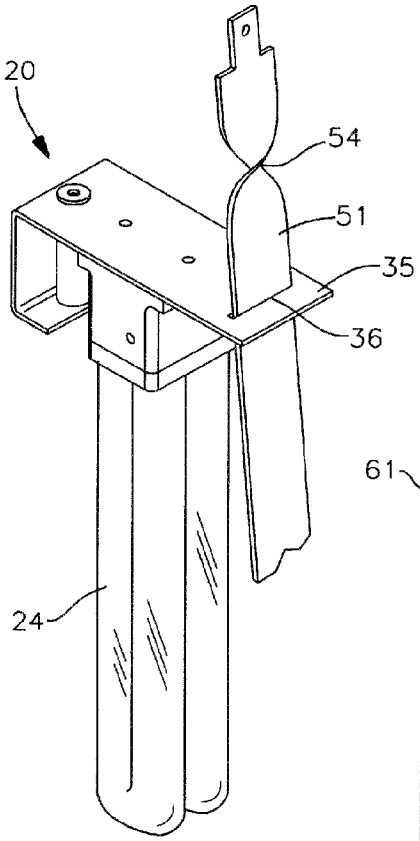
FIGS. 3-6 are perspective views of various components of the invention.
Figure 3:
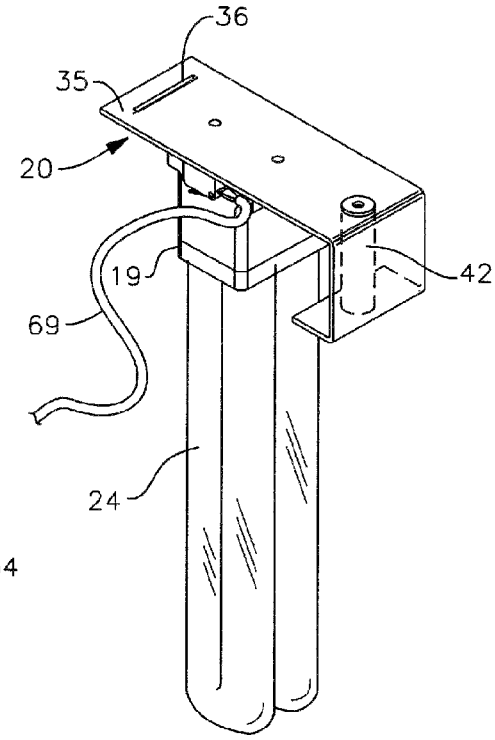
Figure 4:
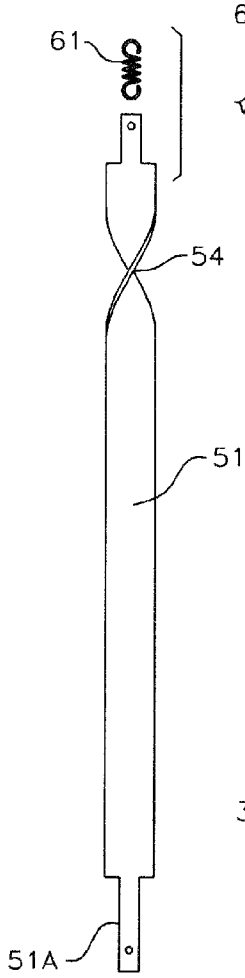

FIGS. 4 and 5 show the lid control shaft 51 as having the form of an elongate metal strip. Shaft 51 is mounted for rotation within a hole in a bearing 57 attached to actuator assembly 30 and through a hole in an element 38B fixed in a hole in flange 33. An extension spring 61 attached between the upper end of shaft 51 and the closed (upper) end of housing 13 continuously urges shaft 51 upwards (toward the closed end) of housing 13.

Figure 6:
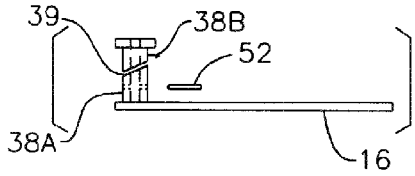

A tab 35 projecting transversely from carrier assembly 20 has a slot 36 shown in FIGS. 5 and 6 through which shaft 51 also passes. Shaft 51 includes a section 54 having an approximately 180° twist, although a twist of as little as one-fifth of a revolution may be adequate. The twist must swing lid 16 sufficiently from the opening of housing 13 to allow light source 19 to reach its deployed position without interference from lid 16.

As carrier assembly 20 moves toward the deployed position, a slot 36 in tab 35 (see FIGS. 3, 5) traverses through twisted section 54. While traversing through section 54, slot 36 in tab 35 causes shaft 51 to rotate within element 38B and bearing 57, through the approximately 180° twist in section 54.

The lid actuator assembly components shown in FIG. 6 comprise elements 38A and 38B. Elements 38A and 38B have between them, a sloped interface at 39 in the form of a cam and follower. Element 38A is fixed to lid 16 and attached to tab 51A (FIG. 4) of shaft 51 by pin 52 (FIG. 6).

During the portion of a deployment while slot 36 traverses section 54, shaft 51 rotates approximately 180°. The rotation of shaft 51 causes the sloped interface 39 to translate element 38A and lid 16 axially downwards from flange 27 while lid 16 rotates away from the opening at the bottom of housing 13 into the position shown in phantom at 16'. The axial position of twisted section 54 creates this translation and rotation of lid 16 before the bottom end of light source 24 reaches the upper surface of lid 16. Spring 61 provides constant axial force on shaft 51 urging shaft 51 and lid 16 upwards during deployment and then while deployed.

Fixture 10 activates when receiving power at a connector 68. Cable 69 conducts current to base 19 for powering light source 19. Cable 69 also carries current to a switch 67 mounted on carrier assembly 20. Switch 67 controls power to drive motor 48. A lever 67A on switch 67 operates to close switch 67 when contacting a feature on flange 33, which occurs as carrier assembly 20 nears the fully deployed position. Switch 67 contains a second contact set controlled by a lever, not shown, to stop motor 48 as base 19 completes retraction to the standby state.

FIGS. 7-10 show an emergency light fixture 10' with a second type of actuator mechanism. Reference numbers track those in FIGS. 1-6 where appropriate.

Carrier assembly 20' supports a bank of LEDs 86. A pair of counterbalance springs 83A and 83B support carrier 20' in the standby position.

Figure 9:
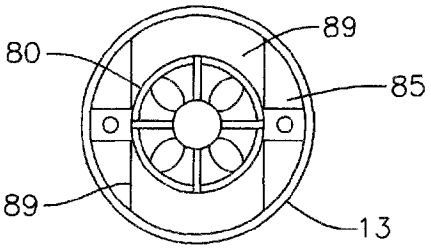
FIGS. 7-10 are top and side elevation views of a second version of the invention.
Figure 10:
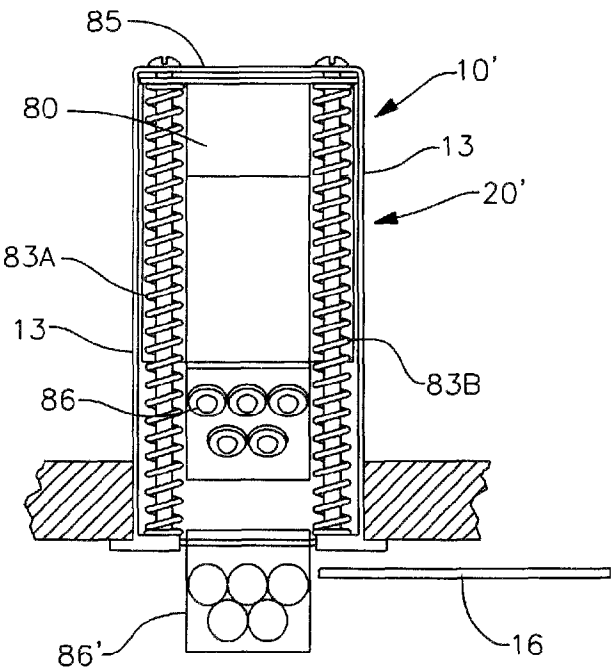
Figure 7:
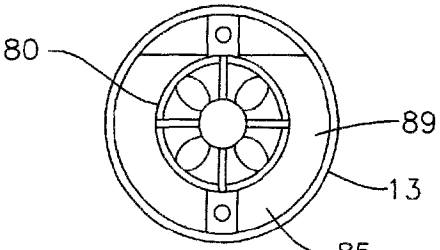
Figure 8:
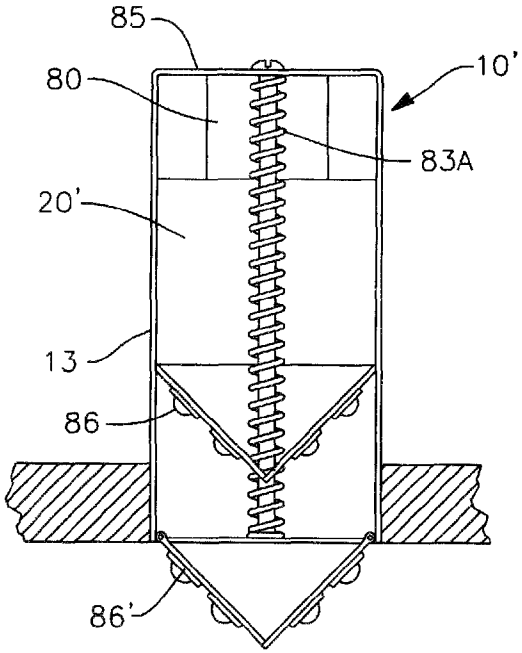

The top views of FIGS. 7 and 9 show a fan 80 (comprising a motor and impeller) mounted within housing 13 on the cover 85. FIGS. 7 and 9 show the cover 85 of housing 13 with slots or louvers 89 through which fan 80 draws and downwardly directs air toward carrier 20'.

Fan 80 serves as the actuator mechanism to provide aerodynamic force on carrier assembly 20' that exceeds the support force of springs 83A and 83B. The aerodynamic force of fan 86 pushes carrier assembly 20' from a standby position toward the deployed position shown at 86' in FIGS. 8 and 10, with the deployed LED bank 86 projecting from housing 13.

High output LEDs generate a substantial amount of heat. Fan 80 also functions to cool the LED bank 86 when in the deployed position and producing light. Lid 16 may be supported by a mechanism similar to that shown in FIGS. 2-6.

Fan 80 may be reversible so air can be forced in either direction within and along the axis of housing 13. In this case springs 83A and 83B may be much weaker than if they provide all of the retracting force. Friction in combination with the force of springs 83A and 83B holds carrier assembly 20' in the standby position.

A reversible fan 80 may even make springs 83A and 83B unnecessary for retracting assembly 20'. A spring finger or other friction-generating element that carrier assembly 20' carries may rub against housing 13 to create drag for holding assembly 20' in place. These designs require fan 80 to generate aerodynamic retraction force on assembly 20' sufficient to overcome both the drag force and the weight of assembly 20' when fixture 10 is installed in a ceiling.

Alternately a detent notch may cooperate with a finger to securely maintain assembly 20' in the retracted position. Fan

80 force is greatest when assembly 20' is in standby position, allowing fan 80 to overcome the detent force.

To cool LED banks 86, fan 80 may continue to run after completing retraction of assembly 20'.

The invention claimed is:

1. A safety unit for mounting in a wall defining a part of a building space, said safety unit activating responsive to electrical power, said safety unit comprising:

a) a tubular housing having first and second ends, with an axis extending along the length of the housing, said tubular housing configured for mounting within a cavity of a wall, with the second end of the housing substantially flush with an outer surface of the wall;

b) an emergency load sized to fit within the housing, said emergency load including a base and a light-emitting element;

c) a guide within the housing and mechanically interacting with the base, and extending generally along the housing's axis, said guide's interaction with the base allowing translation of the base generally along the housing axis from a standby position adjacent to the housing's first end to a deployed position adjacent to the housing's second end when the base receives force, said base supporting the lighting element to place the lighting element within the housing when in the storage position and outside the housing when in the deployed position;

d) an actuator mechanism carried on the housing to provide force to the base responsive to electrical power, said actuator mechanism comprising a motor mounted on the housing and rotating a shaft responsive to actuating power and a jackscrew extending along the housing's axis and receiving torque from the motor;

e) a cover at the second end of the housing, mounted for rotation between first and second positions respectively closing and opening the second end of the housing; and f) a linkage within the housing transmitting force to the cover to rotate the cover between the first and second positions responsive to force received from the linkage, said linkage comprising i) a tab projecting from the base substantially transversely to the housing axis, said tab having a slot therein; and ii) an elongate strip having first and second ends mounted for rotation about its length within the housing and extending along the housing's axis with the first ends of the housing and strip adjacent and the second ends of the housing and strip adjacent, said strip passing through the tab's slot, and said cover attached to the second end of the strip, said strip having a twist therein.

2. The apparatus of claim 1, wherein the twist in the strip is adjacent to the strip's first end and between the base's tab and the strip's second end.

3. The apparatus of claim 1 wherein the strip's twist is at least a fifth of a complete revolution.

4. The apparatus of claim 2 including first and second bearings attached to the housing near the first and second ends thereof and mounting the strip for rotation, and third and fourth bearings attached to the housing near the first and second ends thereof and mounting the jackscrew for rotation.

5. The apparatus of claim 4, wherein the bearings allow axial translation of the strip, and wherein the apparatus further comprises:

a) a spring urging the strip toward the housing's first end; and b) a cam and follower connected between the strip and the cover, said cam and follower axially shifting the cover away from the housing's second end responsive to rotation of the strip.

6. A safety unit for mounting in a wall defining a part of a building space, said safety unit activating responsive to electrical power, said safety unit comprising:

a) a tubular housing having first and second ends, with an axis extending along the length of the housing, said tubular housing configured for mounting within a cavity of a wall, with the second end of the housing substantially flush with an outer surface of the wall;

b) an emergency load sized to fit within the housing, said emergency load including a base and a light-emitting element;

c) a guide within the housing and mechanically interacting with the base, and extending generally along the housing's axis, said guide's interaction with the base allowing translation of the base generally along the housing axis from a standby position adjacent to the housing's first end to a deployed position adjacent to the housing's second end when the base receives force, said base supporting the lighting element to place the lighting element within the housing when in the storage position and outside the housing when in the deployed position;

d) an actuator mechanism carried on the housing to provide force to the base responsive to electrical power; and e) a spring connected between the housing and the base and urging the base toward the housing's first end, wherein the actuator comprises a motor and a fan driven by the motor and within the housing, to force a stream of air within the housing and toward the base, of strength sufficient to overcome the spring force on the base and shift the base toward the deployed position.

7. The apparatus of claim 6, wherein the fan is mounted adjacent to the housing's first end.

* * * * *